US007588379B2

(12) United States Patent
Kato

(10) Patent No.: US 7,588,379 B2
(45) Date of Patent: Sep. 15, 2009

(54) DRIVE MOTOR CONTROL METHOD AND PRINTER

(75) Inventor: Shinji Kato, Kanagawa (JP)

(73) Assignee: Sony Corporation, Tokyo (JP)

( * ) Notice: Subject to any disclaimer, the term of this patent is extended or adjusted under 35 U.S.C. 154(b) by 318 days.

(21) Appl. No.: 11/499,222

(22) Filed: Aug. 4, 2006

(65) Prior Publication Data

US 2007/0041739 A1 Feb. 22, 2007

(30) Foreign Application Priority Data

Aug. 10, 2005 (JP) ..... 2005-231794

(51) Int. Cl.
*B41J 19/00* (2006.01)
*B41J 19/30* (2006.01)

(52) U.S. Cl. ..... 400/323; 400/124.02; 400/319

(58) Field of Classification Search ..... 400/124.02, 400/124.04–124.05, 319, 323–323.1; 347/5–6
See application file for complete search history.

(56) References Cited

U.S. PATENT DOCUMENTS 3,986,091 A 10/1976 Quiogue et al.
4,541,747 A * 9/1985 Imaizumi et al. ..... 400/144.2
2004/0246290 A1 * 12/2004 Hayashi et al. ..... 347/19
2005/0146555 A1 7/2005 Igarashi et al.

FOREIGN PATENT DOCUMENTS

JP 2000-301793 * 10/2000
JP 2004-284367 10/2004

* cited by examiner

*Primary Examiner*—Judy Nguyen
*Assistant Examiner*—Marissa L Ferguson-Samreth
(74) *Attorney, Agent, or Firm*—Robert J. Depke; Rockey, Depke & Lyons, LLC

(57) ABSTRACT

A method of controlling a drive motor that is provided to a printer to apply a driving force to a predetermined operation section that operates in an image printing operation of printing on a printing sheet. The method includes steps of: measuring, in a no-image-printing operation of not printing on the printing sheet, an initial operation time of the predetermined operation section by driving initially the drive motor to operate the operation section; driving, in the image printing operation of printing on the printing sheet, the drive motor with a first output from an operation start time to a time calculated by multiplying the initial operation time by a coefficient that is larger than 0 but smaller than 1; and driving, until an operation end time after the drive motor is driven with the first output, the drive motor with a second output that is determined based on the initial operation time.

8 Claims, 9 Drawing Sheets

FIG. 4

| INITIAL OPERATION TIME T | DRIVE VOLTAGE |
|---|---|
| $T < 120ms$ | 60% |
| $120ms \leq T < 180ms$ | 80% |
| $T \geq 180ms$ | 100% |

DRIVE MOTOR CONTROL METHOD AND PRINTER

CROSS REFERENCES TO RELATED APPLICATIONS

The present invention contains subject matter related to Japanese Patent Application JP 2005-231794 filed in the Japanese Patent Office on Aug. 10, 2005, the entire contents of which being incorporated herein by reference.

BACKGROUND OF THE INVENTION

1. Field of the Invention

The present invention relates to a drive motor control method and a printer and, more specifically, to a technology field of making a predetermined operation section operate appropriately by exercising control over the drive state of a drive motor based on an initial operation time measured for the operation section.

2. Description of the Related Art

Some printers perform image printing by thermal transfer printing, laser printing, or others for printing on sheets including photographic paper and photographic film. With such printers, their cabinets each carry therein predetermined operations sections, e.g., a sheet extraction mechanism that extracts printing sheets from a sheet tray, a sheet transfer mechanism that transfers the printing sheets, a roller movement mechanism that moves rollers of the sheet transfer mechanism to their appropriate positions, a head drive mechanism that moves a photographic head to its appropriate position for image printing on the printing sheets, and a sheet cutting mechanism that cuts the printed sheets into any predetermined size.

The components of these operation sections often operate in response to the driving force of a drive motor, e.g., direct-current motor, and the drive motor is under the control of a control section equipped with a microcomputer or others.

A printer using a continuous roll of printing sheet is provided with a sheet cutting mechanism, for example. The cutter of the sheet cutting mechanism rotates and moves in the direction across the printing sheet by a drive motor so that the printing sheet is accordingly cut.

The sheet cutting mechanism is provided with a fixed blade extending in the cutting direction of the printing sheet, a stopper disposed at the limit edge of a cutter to move, and a sensor that detects the position of the cutter after movement. The drive motor rotates the cutter while making it slide in contact with the fixed blade so that the printing sheet is cut. After the cutting of the printing sheet, the sensor detects the limit edge of the cutter to move, and the drive motor stops driving. At the same time, a carriage supporting the cutter to freely rotate comes into contact with the stopper so that the carriage and the cutter both stop moving.

The problems with such a previous printer are that the large shock and a lot of noise due to collision of the carriage with the stopper are generated, and that the carriage does not stop at its predetermined position due to the rebound by the collision with the stopper. These are caused because the drive motor is defined by driving conditions based on maximum load, i.e., based on startup of the drive motor for the sheet cutting mechanism, and the drive motor is typically under the high drive voltage, i.e., not only at the startup thereof but also until the cutter completes the cutting of the printing sheet. This thus results in the faster movement speed of the cutter, thereby increasing the inertial force, which is the cause of the above problems.

In order to solve such problems, considered is a possibility of applying a low drive voltage to the drive motor from the startup thereof, but this may cause another problem of failing to appropriately start the drive motor, or taking longer time to cut the printing sheet due to the low-speed rotation of the drive motor, for example.

To solve such problems, some previous printers control the rotation speed of a drive motor to operate appropriately, e.g., prevent the shock and noise as above from being generated. For the purpose, the parameter data about the control of the drive motor is measured in the test before shipment, and the measurement result is stored in a nonvolatile memory to be read and corrected as appropriate when the drive motor is driven. As an example, refer to Patent Document 1 (JP-A-2004-284367)

SUMMARY OF THE INVENTION

The measurement of the parameter data about the control of the drive motor is made based on the operation time or others of any predetermined operation section provided to the printer. The operation time or others of the predetermined operation section may vary depending on the characteristics' variations or characteristics' changes over time observed among the drive motors in the printers.

With the previous printer of Patent Document 1, the parameter data about the control of the drive motor is indeed measured with consideration to the characteristics' variations among the drive motors because such parameter data is measured for every printer in the test before shipment. The resulting parameter data, however, is not ready for the characteristics' changes over time of the drive motor.

With characteristics' changes over time of the drive motor as such at the time of shipment of the printer, controlling the rotation speed of the drive motor based on the parameter data may fail in appropriately operating the printer, e.g., preventing possible shock and noise, or making the operation section remain stopped at appropriate position.

It is thus desirable to provide a drive motor control method and a printer with which the above-described problems can be favorably solved, and a predetermined operation section that operates by a driving force of a drive motor can be made to operate appropriately.

According to an embodiment of the invention, there is provided a drive motor control method. In a no-image-printing operation of not printing on a printing sheet, an initial operation time of a predetermined operation section is measured by driving initially the drive motor to operate the operation section. In an image printing operation of printing on the printing sheet, the drive motor is driven with a first output from an operation start time to a time calculated by multiplying the initial operation time by a coefficient that is larger than 0 but smaller than 1. Until an operation end time after the drive motor is driven with the first output, the drive motor is driven with a second output that is determined based on the initial operation time.

According to the embodiment of the invention, there is also provided a printer that includes: a predetermined operation section that operates in an image printing operation of printing on a printing sheet; a drive motor that applies a driving force to the predetermined operation section, and performs initial drive in a no-image-printing operation of not printing on the printing sheet; a control section that controls the drive state of the drive motor; and a timer that counts an initial operation time of the predetermined operation section that is operated in the initial drive of the drive motor. In the printer, in the image printing operation of printing on the printing sheet, the drive motor is driven with a first output from an operation start time to a time calculated by multiplying the initial operation time by a coefficient that is larger than 0 but smaller than 1, and until an operation end time after the drive motor is driven with the first output, the drive motor is driven with a second output that is determined based on the initial operation time.

As such, with the drive motor control method and the printer according to the embodiment of the invention, the rotation speed of the drive motor is controlled in accordance with the initial operation time.

Another embodiment of the invention is directed to a method of controlling a drive motor that is provided to a printer to apply a driving force to a predetermined operation section that operates in an image printing operation of printing on a printing sheet. In the method, in a no-image-printing of not printing on the printing sheet, an initial operation time of the operation section is measured by driving initially the drive motor to operate the predetermined operation section. In the image printing operation of printing on the printing sheet, the drive motor is driven with a first output from an operation start time to a time calculated by multiplying the initial operation time by a coefficient that is larger than 0 but smaller than 1. Until an operation end time after the drive motor is driven with the first output, the drive motor is driven with a second output that is determined based on the initial operation time.

With such a method, the characteristics' variations or the characteristics' changes over time observed among the drive motors are used as a basis to drive and control the drive motor so that any possible shock and noise can be reduced in the operation section, for example.

In the aspect, after the drive motor is driven with the first output, the time remaining until the operation end time is split into a plurality of segments, and the drive motor is driven with outputs varying among the split segments. This favorably leads to better flexibility for drive control.

Another embodiment of the invention is directed to a printer that includes: a predetermined operation section that operates in an image printing operation of printing on a printing sheet; a drive motor that applies a driving force to the predetermined operation section, and performs initial drive in a no-image-printing operation of not printing on the printing sheet; a control section that controls the drive state of the drive motor; and a timer that counts an initial operation time of the predetermined operation section that is operated in the initial drive of the drive motor. In the printer, in the image printing operation of printing on the printing sheet, the drive motor is driven with a first output from an operation start time to a time calculated by multiplying the initial operation time by a coefficient that is larger than 0 but smaller than 1. Until an operation end time after the drive motor is driven with the first output, the drive motor is driven with a second output that is determined based on the initial operation time.

With such a printer, the characteristics' variations or the characteristics' changes over time observed among the drive motors are used as basis to drive and control the drive motor so that the possible shock and noise can be reduced in the operation section, for example.

BRIEF DESCRIPTION OF THE DRAWINGS

FIG. 4 is a diagram showing table data;

DESCRIPTION OF THE MOST PREFERRED EMBODIMENT

In the below, described are a drive motor control method and a printer of an embodiment of the invention by referring to the accompanying drawings.

Figure 1:
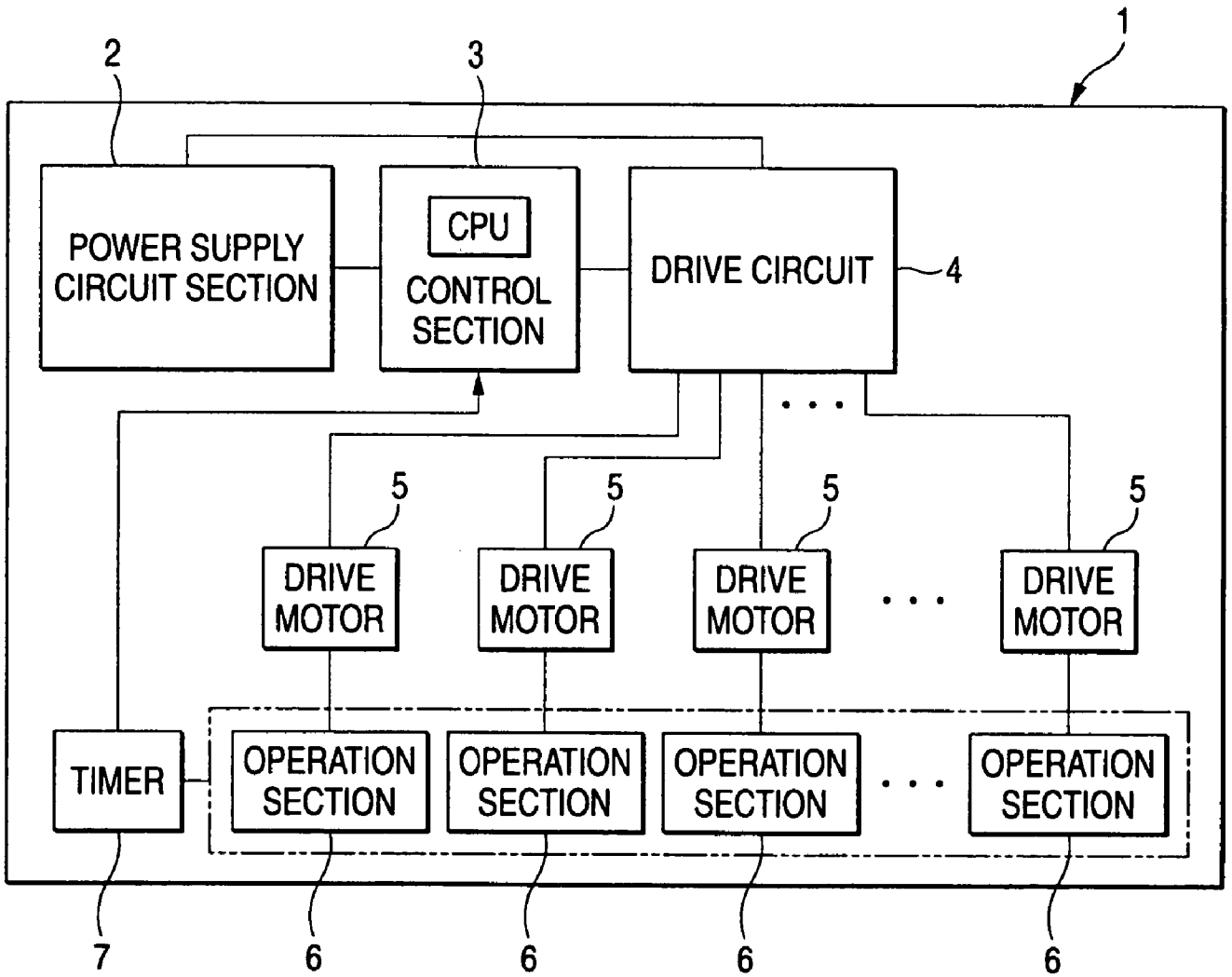
FIG. 1 shows, together with FIGS. 2 to 9, the most preferable embodiment of the invention, and is a block diagram showing the configuration of a printer.

A printer 1 is configured to include a power supply circuit section 2, a control section 3, and a drive circuit 4 (refer to FIG. 1).

The power supply circuit section 2 is connected to a commercial power supply, for example, for supplying power to any predetermined components, e.g., the control section 3, and the drive circuit 4.

The control section 3 is a microcomputer, for example, and takes charge of driving and controlling the components in the printer 1, especially driving and controlling drive motors that will be described later. The control section 3 is provided with a CPU (Central Processing Unit) 3*a* that executes various types of data processing and computation processing. Based on the data processing and computation processing executed by the CPU 3*a*, the control section 3 sends out a drive signal to the drive circuit 4, and issues an operation command against the drive circuit 4.

Based on the drive signal coming from the control section 3, the drive circuit 4 drives drive motors 5. It means that the drive motors 5 are driven and controlled by the control section 3 via the drive circuit 4. The drive motors 5 are each exemplified by a direct current motor.

Operation sections 6 are operated when an image printing operation is executed with respect to printing sheets. The printer 1 is provided with, as the operation sections 6, various mechanisms, e.g., a sheet extraction mechanism that extracts printing sheets from a sheet tray, a sheet transfer mechanism that transfers the printing sheets, a roller movement mechanism that moves rollers of the sheet transfer mechanism to their appropriate positions, a head drive mechanism that moves a photographic head to its appropriate position for image printing on the printing sheets, and a sheet cutting mechanism that cuts the printed sheets into a predetermined size. These operation sections 6 are operated by a driving force coming from their corresponding drive motors 5.

The printer 1 is provided with a timer 7 for counting an initial operation time (will be described later) of the operation sections 6. The initial operation time counted by the timer 7 is sent out to the control section 3 as time data.

Figure 2:
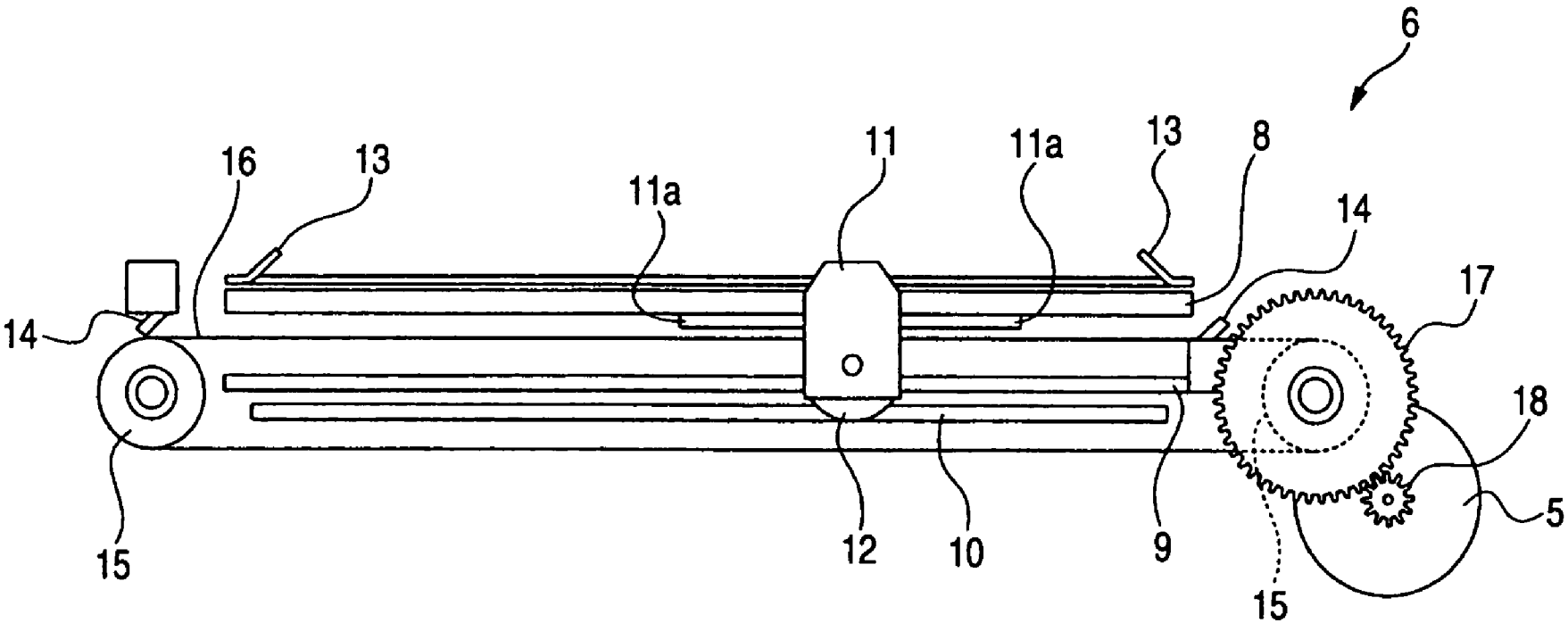
FIG. 2 is a front view of a sheet cutting mechanism provided as an operation section.

Described below is the sheet cutting mechanism as an example of the operation section 6 (refer to FIG. 2).

The operation section, i.e., the sheet cutting mechanism, 6 is provided with a carriage guide 8, a cutter guide 9, and a fixed blade 10, which all extend in the direction of cutting a printing sheet, i.e., in the direction across the printing sheet being a continuous roll of sheet. The carriage guide 8, the cutter guide 9, and the fixed blade 10 are disposed with a space from one another in the vertical direction.

The carriage guide 8 supports a carriage 11 to freely move, and the carriage 11 supports a disk-shaped cutter 12 to freely rotate. The carriage 11 is provided with a protrusion portion 11*a* that protrudes in the direction opposite to another protrusion portion 11*a*.

The operation section 6 is provided with a stopper 13 and a sensor 14 at one limit edge of the carriage 11 to move, and at the other limit edge thereof, another stopper 13 and sensor 14 are disposed.

The operation section 6 supports a pulley 15 to freely rotate at one limit edge of the carriage 11 to move, and at the other limit edge thereof, another pulley 15 is supported also to freely rotate. The pulleys 15 support therebetween a transfer wire 16, which is fed by the rotation of the pulleys 15. The transfer wire 16 is partially fixed to the carriage 11.

One of the pulleys 15 is disposed coaxial with a deceleration gear 17, and the deceleration gear 17 is meshed with a drive gear 18 fixed to the motor axis of the driver motor 5.

In the operation section 6 configured as such, when the drive circuit 4 rotates the drive motor 5, the driving force is transmitted to the carriage 11 via the drive gear 18, the deceleration gear 17, the pulleys 15, and the transfer wire 16. In response to the driving force, the carriage 11 is guided to the carriage guide 8, and is moved from one of the movement limit edges, i.e., starting edge, in the cutting direction of the printing sheet to the other movement limit edge, i.e., ending edge. At this time, the cutter 12 is rotated while being slid in contact with the fixed blade 10, whereby the printing sheet is accordingly cut. After the cutting of the printing sheet, the drive motor 5 is rotated in the reverse direction so that the carriage 11 located at the ending edge is put back to the starting edge.

When the carriage 11 is moved to the limit edge in the possible range to move, one of the protrusion portions 11*a* of the carriage 11 abuts one of the sensors 14 so that the sensor 14 detects the movement limit edge of the cutter 12 and the drive motor 5 stops driving. When the carriage 11 partially abuts one of the stoppers 13, the carriage 11 responsively stops moving.

Figure 3:
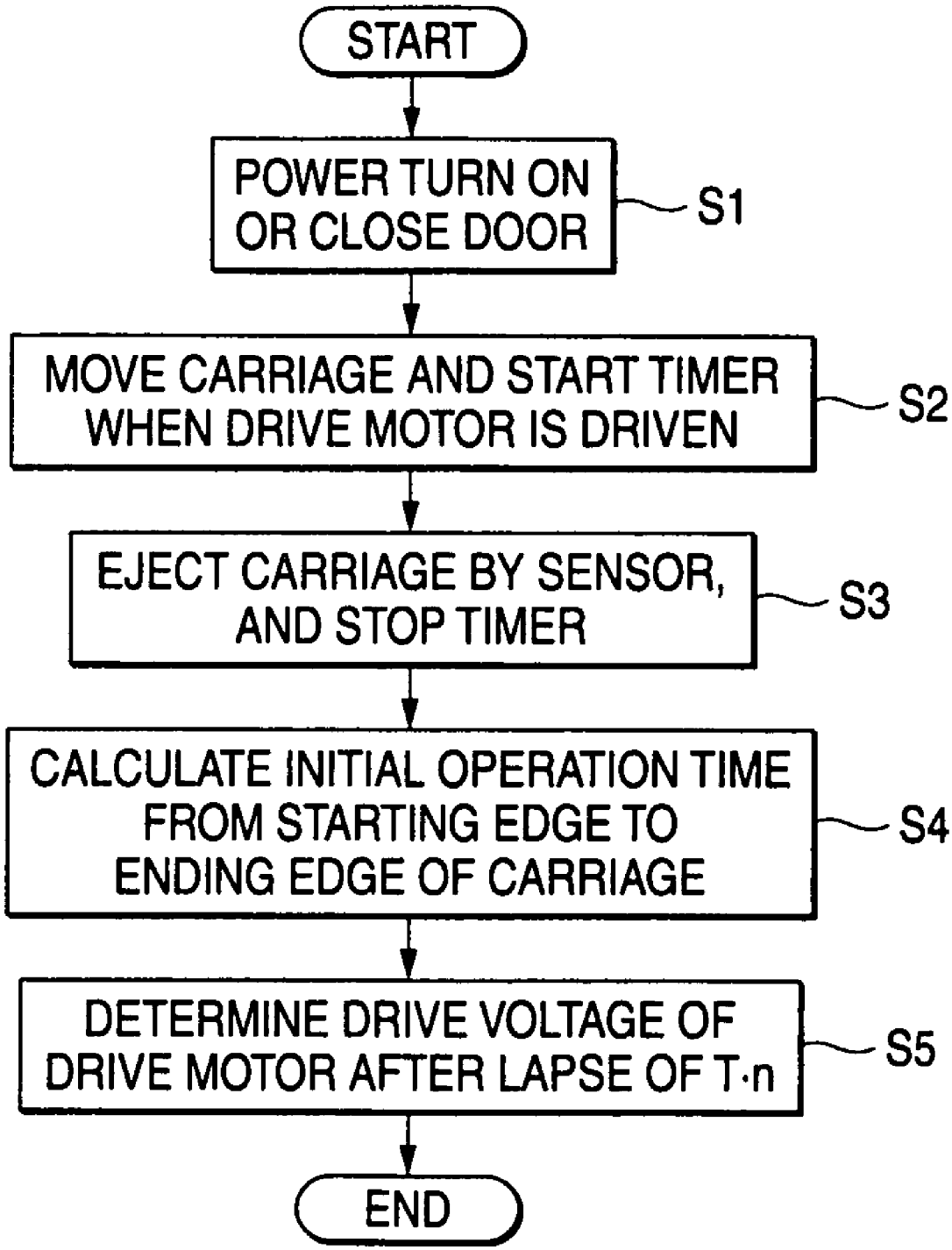
FIG. 3 is a flowchart diagram showing a procedure of determining a drive voltage.

Described next is the drive control over the drive motor 5 (refer to FIGS. 3 to 5).

The printer 1 exercises drive control over the drive motor 5 to achieve the appropriate operation, e.g., preventing the shock and noise possibly caused by collision between the carriage 11 and the stopper 13 when the carriage 11 is moved to its one movement limit edge, making the carriage stop at its predetermined position without fail even if rebound occurs, stopping the reduction of the processing speed, and others.

The drive control over the drive motor 5 is applied as below after a drive voltage is determined for application to the drive motor 5 (refer to FIG. 3).

(S1) When the printer 1 is turned on through operation of a power supply button provided thereto, or when a door of a paper tray is closed while the printer 1 is being turned on, the drive motor 5 is initially driven. During the initial drive, no image printing operation is performed with respect to the printing sheet, and the drive motor 5 is driven in a manner for a no-image-printing operation.

(S2) The drive motor 5 is driven by a predetermined drive voltage, e.g., the maximum drive voltage, and the carriage 11 is accordingly moved from a starting edge to an ending edge. The predetermined drive voltage is surely not restrictive to the maximum drive voltage, and may be of a value allowing the carriage 11 to move without fail. At the same time as the carriage 11 moves, the timer 7 start counting.

(S3) The protrusion portion 11*a* of the carriage 11 abuts the sensor 14, and the timer 7 responsively stops counting.

(S4) As a result of the counting operation of the timer 7, the time taken for the carriage 11 to move from the starting edge to the ending edge, i.e., initial operation time T, is calculated.

(S5) Based on thus calculated initial operation time T, e.g., referring to table data relating to an application voltage stored in a memory, a drive voltage is determined for the drive motor 5 with the lapse of a time after the start of operation in the image printing operation. The time is calculated by multiplying the initial operation time T by a coefficient n being larger than 0 but smaller than 1, i.e., time T·n. The table data shows the drive voltage with respect to the initial operation time (refer to FIG. 4). The value of the coefficient n may be arbitrarily determined to be larger than 0 but smaller than 1 with consideration given to various factors, e.g., time taken to cut the printing sheet. With the sheet cutting mechanism of the printer 1, the value is set to 0.7, for example. With the initial operation time T being 100 ms, for example, the drive voltage with the lapse of 70 ms after the carriage 11 starts moving (T=100 ms×0.7) is determined by the table data as 60% of the maximum drive voltage. With the initial operation time T being 150 ms, the drive voltage with the lapse of 105 ms after the carriage 11 starts moving (T=150 ms×0.7) is determined as 80% of the maximum drive voltage. With the initial operation time T being 200 ms, the drive voltage with the lapse of 140 ms after the carriage 11 starts moving (T=200 ms×0.7) is determined as the same as the maximum drive voltage, i.e., 100% of the maximum drive voltage.

After the counting of the initial operation time as such, the drive motor 5 is rotated in the reverse direction, and the carriage 11 located at the ending edge is accordingly moved to the starting edge and then is put on standby.

During the printing operation of printing on the printing sheet, the drive motor 5 is driven in accordance with the initial operation time described above.

Figure 5:
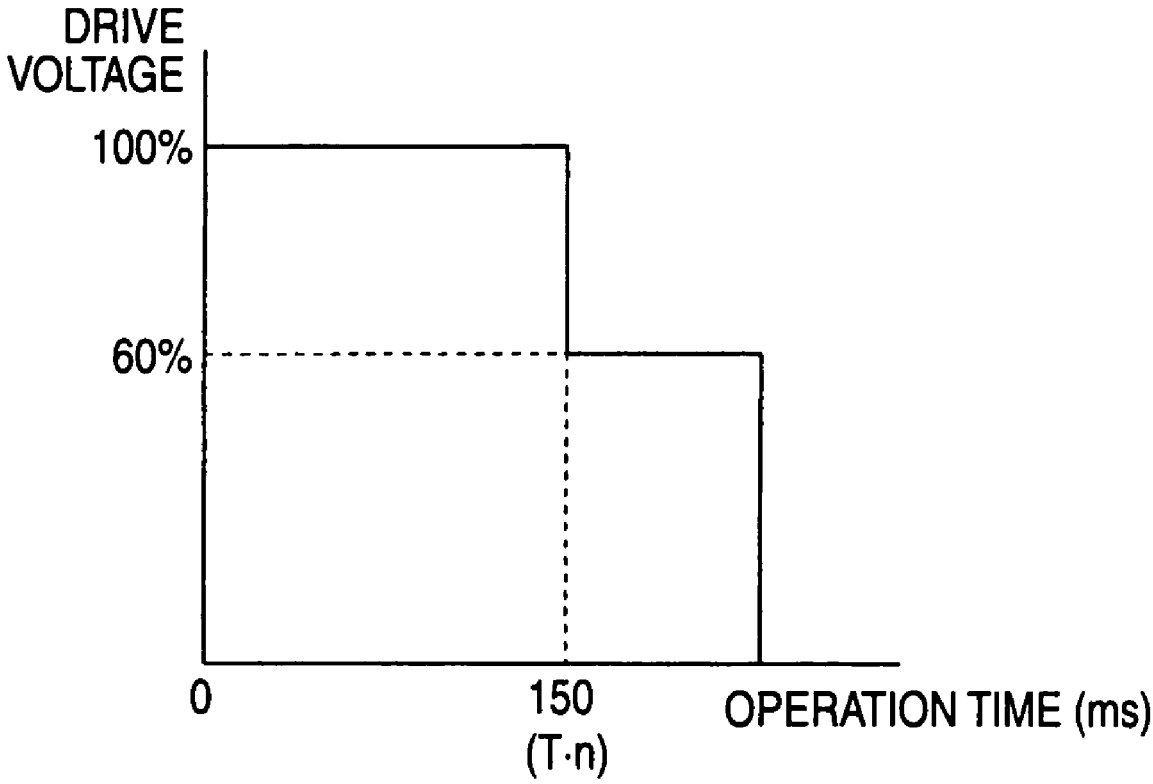
FIG. 5 is a graph diagram showing a drive voltage for application to a drive motor during an image printing operation.

For example, with the initial operation time of 100 ms, as shown in FIG. 5, the drive motor 5 is driven with a predetermined drive voltage, e.g., maximum drive voltage, until the lapse of 70 ms after the carriage 11 starts moving, and with the lapse of 70 ms, the drive motor 5 is driven with a drive voltage being 60% of the maximum drive voltage. Accordingly, with the lapse of 70 ms after the carriage 11 starts moving from the starting edge or the ending edge, the rotation speed of the drive motor 5 is reduced to 60% of the drive voltage before the lapse of 70 ms. With the lower rotation speed of about 60% as such, the carriage 11 abuts the stopper 13 at its ending or starting edge, and then stops moving.

In the above-described example, with the initial operation time T being 180 ms or more, the drive motor 5 is typically driven with the maximum drive voltage even with the lapse of the initial operation time T×coefficient n during the operation of the carriage 11. In this case, because the counted initial driving time T is long as 180 ms, the rotation speed of the drive motor 5 is low so that the carriage 11 abuts the stopper 13, and stops moving also with the low rotation speed.

Figure 6:
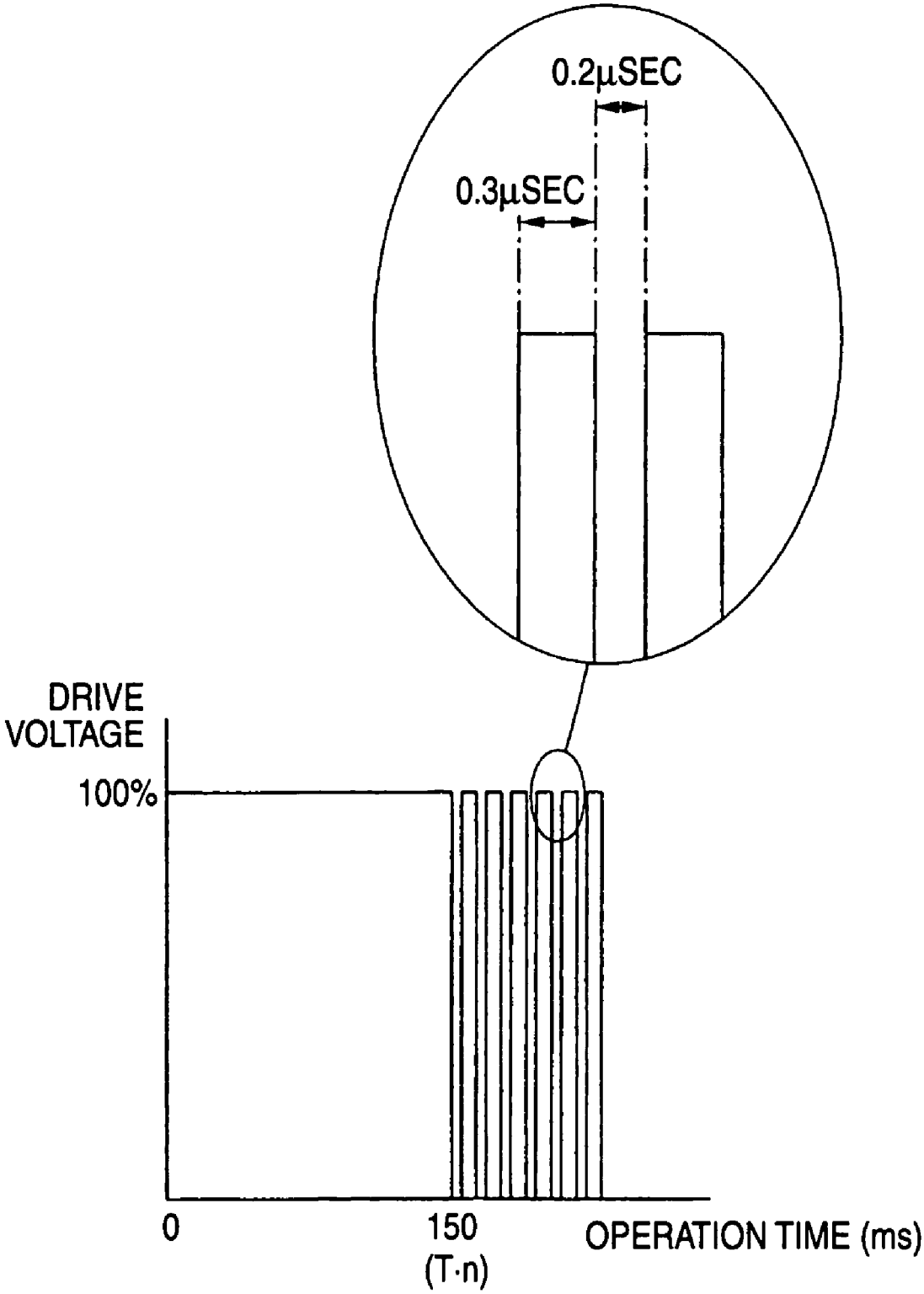
FIG. 6 is a graph diagram showing an exemplary case of exercising PWM (pulse-width modulation) control over the drive motor.

The above description is about the drive control of the drive motor 5, and exemplified above is the case of determining, before the drive control, a drive voltage for application to the drive motor 5. As shown in FIG. 6, PWM (pulse-width modulation) control is also a possible option. Similarly to the above, with the initial operation time T being 100 ms, for example, the drive motor 5 is driven by the maximum drive voltage before the lapse of 70 ms after the carriage 11 starts moving. With the lapse of 70 ms, the pulse width is modulated, and the drive motor 5 is driven. For example, pulses are generated with 30 μsec with intervals of 20 μsec.

As described above, with the printer 1, in the no-image-printing operation of not printing on the printing sheet, the drive motor 5 is initially driven to count the initial operation time T for the operation section 6. In the image printing operation, the drive motor 5 is driven by a predetermined output, i.e., first output, until the lapse of a predetermined time (T·n) after the operation is started, and in accordance with the initial operation time T, the drive motor 5 is then driven with an output, i.e., second output, determined based on the initial operation time T.

As such, the drive motor 5 can be driven and controlled with consideration given to the characteristics' variations or the characteristics' changes over time observed among the drive motors 5. Such drive control successfully achieves the appropriate operation, e.g., reduce the shock and noise possibly caused in the operation sections 6, make the carriage 11 stop at its stop position with relatively high accuracy even if rebound occurs due to collision with the stopper 13, start the drive motor 5 with reliability, and stop the reduction of the sheet cutting processing speed.

Exemplified above is the case that the operation section 6 is the sheet cutting mechanism. The drive control over the drive motor 5 is not restrictive to the sheet cutting mechanism, and any of the operation sections 6 is applicable as long as it operates in response to the driving force of the drive motor 5 in the printer 1.

Figure 8:
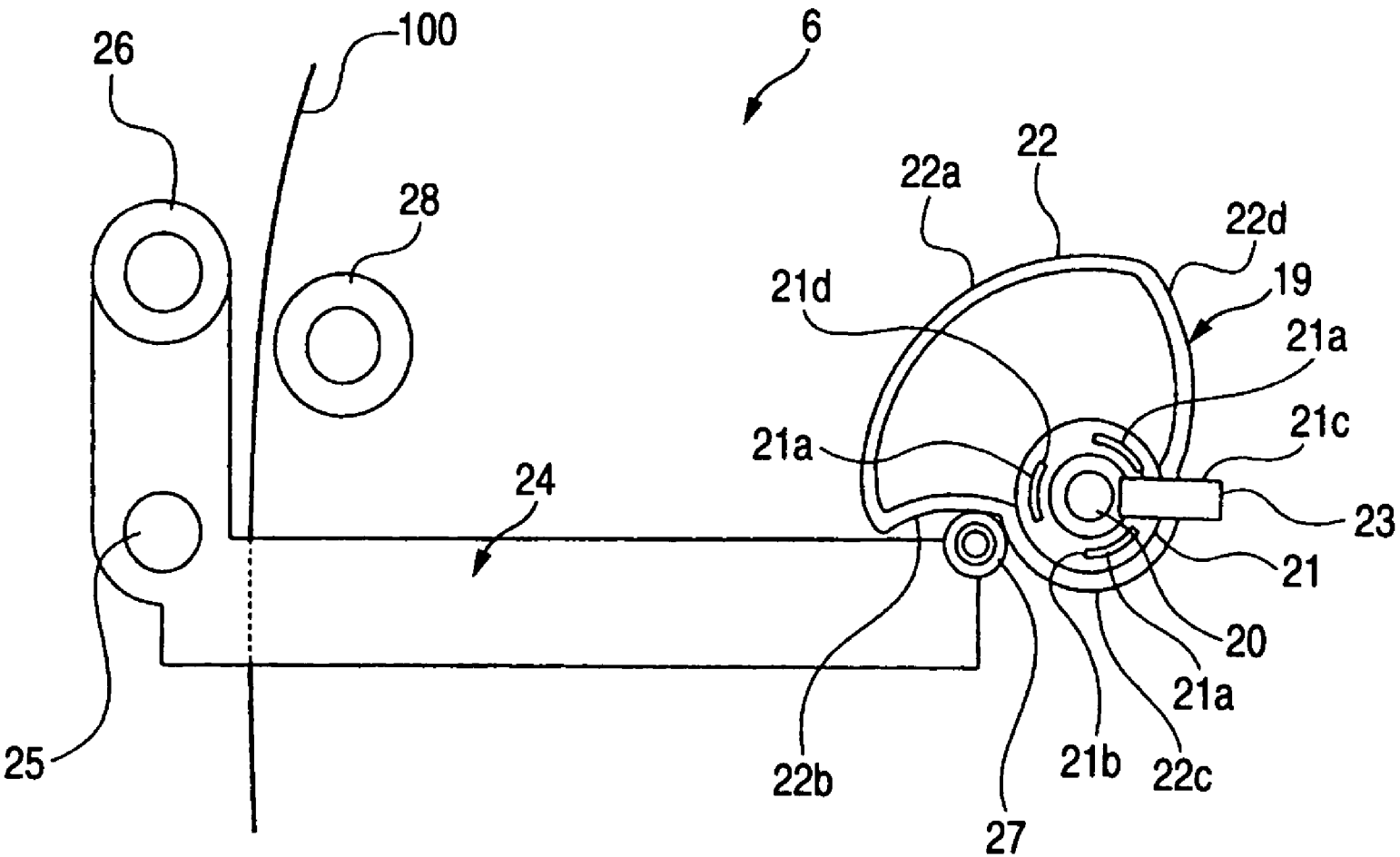
FIG. 8 is an enlarged side view showing an off position.
Figure 9:
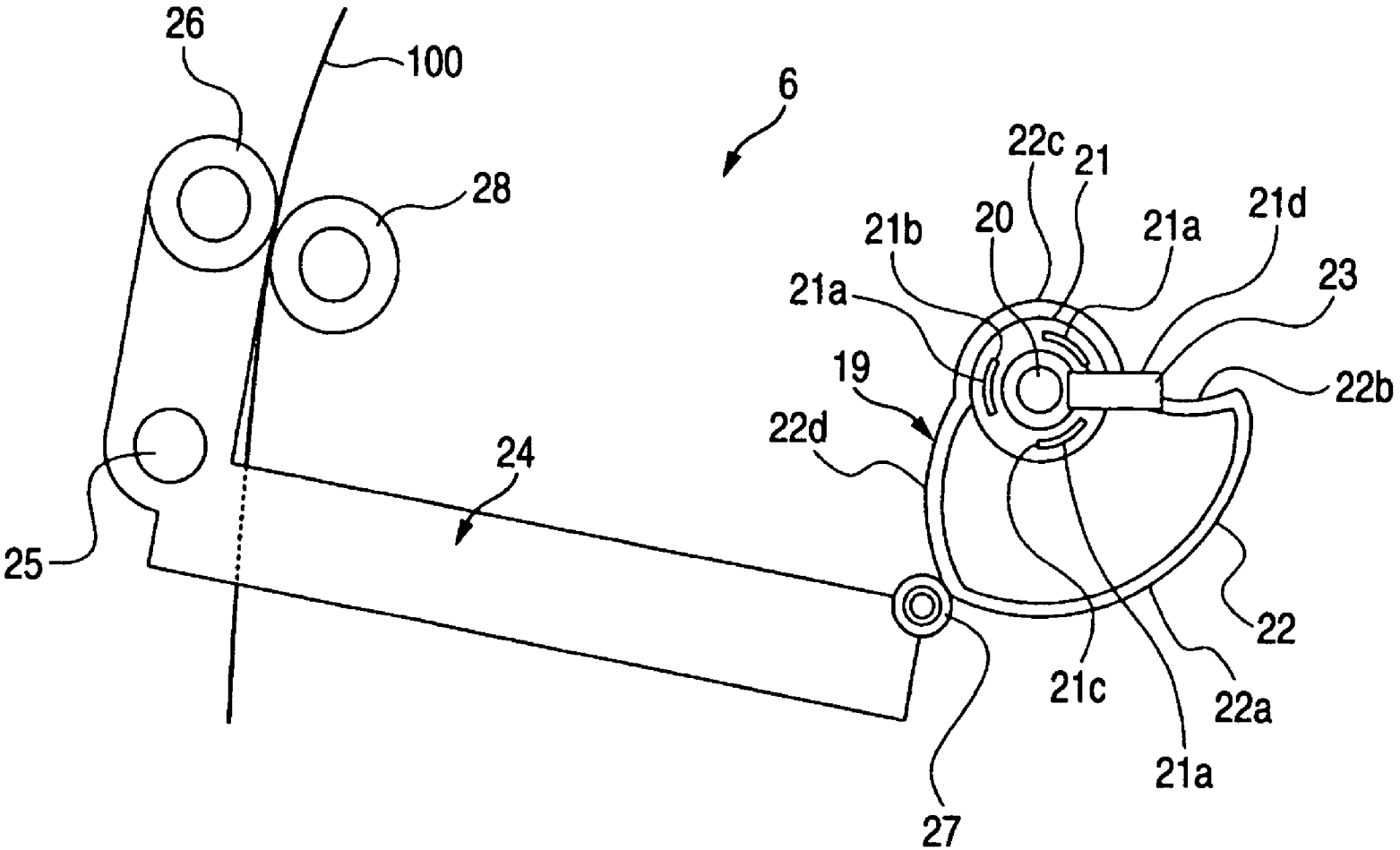
FIG. 9 is an enlarged side view of a lightly-crimped position.

The operation section 6 maybe the sheet transfer mechanism as below, for example (refer to FIGS. 7 to 9).

The operation section, i.e., sheet transfer mechanism, 6 is provided with a rotation cam 19 that is rotated by the driving force of the drive motor 5. The rotation cam 19 is configured by a disk-shaped detection section 21 supported by a support axis 20, and a cam section 22 that is protruding from the detection section 21.

The detection section 21 includes three light shield portions 21*a*, all of which are in the shape of an arc around the support axis 20. The areas among the light shield portions 21*a* are slits 21*b*, 21*c*, and 21*d* for use for detection.

The cam section 22 is configured by first to fourth cam surface portions 22*a* to 22*d* which are in continuous manner. The first cam surface portion 22*a* is in the shape of an arc about the support axis 20 with a large curvature radius. The third cam surface portion 22*c* is also in the shape of an arc about the support axis 20 but with a small curvature radius, and is disposed at the rim of the detection section 21. The second and fourth cam surface portions 22*b* and 22*d* are formed continuously to the edges of the first and third cam surface portions 22*a* and 22*c*.

In the vicinity of the detection section 21 of the rotation cam 19, a sensor 23 is disposed.

The operation section 6 is provided with a roller support arm 24, which is supported with a circular-movement axis 25 serving as a pivot to freely make a circular movement therearound. The roller support arm 24 is in the shape of the letter L, and the bent portion is supported by the circular-movement axis 25. The roller support arm 24 keeps hold of a pinch roller 26 at one end portion, and at the other end portion thereof, a rotation roller 27 is provided. In the roller support arm 24, the rotation roller 27 slides in contact with the cam section 22 of the rotation cam 19, and the contact position between the rotation roller 27 and the cam section 22 is changed as the rotation cam 19 rotates so that the roller support arm 24 makes a circular movement.

Figure 7:
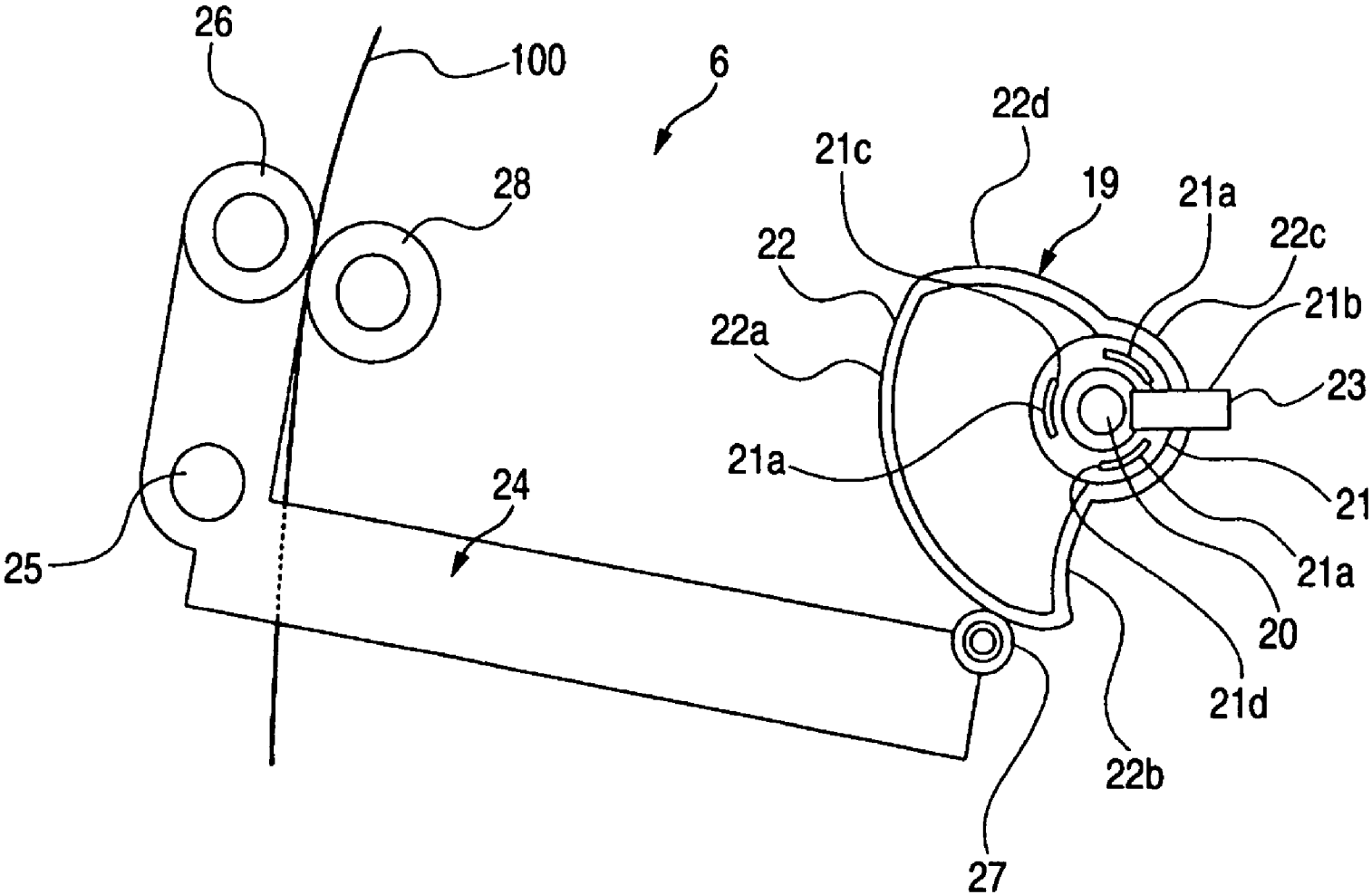
FIG. 7 shows, together with FIGS. 8 and 9, a sheet transfer mechanism provided as an operation section, and is an enlarged side view of a securely-crimped position.

In the state that the rotation roller 27 is abutting the first cam surface portion 22*a* of the cam section 22, the roller support arm 24 is located at a securely-crimped position where the pinch roller 26 is firmly pressed against a capstan roller 28 with a printing sheet 100 sandwiched therebetween (refer to FIG. 7). At this time, the sensor 23 is located at the position corresponding to the slit 21*b*, and the sensor 23 detects the securely-crimped position.

When the rotation cam 19 is rotated in one direction by the driving force of the drive motor 5, the rotation roller 27 comes into contact with the second cam surface portion 22*b* of the cam section 22. The roller support arm 24 then makes a circular movement to an off position at which the pinch roller 26 is apart from the capstan roller 28 with the printing sheet 100 sandwiched therebetween (refer to FIG. 8). At this time, because the sensor 23 is positioned corresponding to the slit 21*c* so that the off position is detected, and the drive motor 5 responsively stops rotating.

When the rotation cam 19 is rotated in one direction to a further degree by the driving force of the drive motor 5, the rotation roller 27 passes through the third cam portion 22*c* of the cam section 22, and then comes into contact with the fourth cam surface portion 22*d*. The roller support arm 24 then makes a circular movement to a lightly-crimped position where the pinch roller 26 is lightly pressed against the capstan roller 28 with the printing sheet 100 sandwiched therebetween (refer to FIG. 9). At this time, the sensor 23 is located at the position corresponding to the slit 21*d* so that the sensor 23 detects the lightly-crimped position, and the drive motor 5 responsively stops rotating.

On the other hand, when the rotation cam 19 is rotated in the other direction, if any mode change is to be made from the securely-crimped position, the mode change is made, in order, from the securely-crimped position, the lightly-crimped position, and the off position.

At the securely-crimped position, the printing sheet 100 is transferred, and at the lightly-crimped position and the off position, the transfer of the printing sheet is stopped.

When the drive motor 5 is driven, the load of the drive motor 5 is maximum at the securely-crimped position, and at the lightly-crimped position, the load of the drive motor 5 is second to maximum. The drive motor 5 is minimum in load when driven at the off position.

In such an operation section 6 changing the load to the drive motor 5 with three or more levels, when the drive motor 5 is subjected to drive control, the time after the lapse of a time calculated by multiplying the initial drive time T by a coefficient n, i.e., T·n, is segmented into two or more levels. In each of the resulting segments, the drive motor 5 is applied with any appropriate drive voltage.

More specifically, when the printer 1 is turned on through operation of an operation button provided thereto, or when a door of a paper tray is closed while the printer 1 is being turned on, the drive motor 5 is initially driven, and the timer 7 starts calculating the initial operation time T of the rotation cam 19.

Based on thus calculated initial operation time T, the table data is referred to for determining a drive voltage for application to the drive motor 5 with the lapse of a time after the start of operation in the printing operation. The time is calculated by multiplying the initial operation time T by a coefficient n being larger than 0 but smaller than 1, i.e., time T·n. Such a drive voltage is determined for every segment of time as a result of time segmentation after the lapse of the time T·n.

With time segmentation after the lapse of the time T·n, and with determination of a drive voltage for each of the segments, the drive voltage can be appropriate for application to drive motor 5 with consideration given to the load thereon. This is suitable for the operation section 6 changing the load to the drive motor 5 with three or more levels in a row as the drive motor 5 changes in position from the securely-crimped position to the lightly-crimped position via the off position. As exemplary control application, when the drive motor 5 is started up under the heavy load, a high drive voltage is applied to the drive motor 5 so that a setting is made to apply a lower drive voltage to the drive motor 5 under the light load. When the drive motor 5 is continuously driven under the heavy load, a drive voltage higher than immediately before is applied to the drive motor 5.

When the initial operation time T is long, irrespective of the size of the load on the drive motor 5, a drive voltage of a constant level may be applied to the drive motor 5 before and after the lapse of time T·n to operate the operation section 6. With this being the case, the rotation speed of the drive motor 5 is low due to the long initial operation time T, and thus the rotation speed of the drive motor 5 is not unnecessarily increased also under the light load.

Note here that when the drive motor 5 is driven and controlled in such an operation section 6, the PWM control is also a possible option.

As described above, also in the operation section 6 changing the load to the drive motor 5 with three or more levels, the drive motor 5 can be driven and controlled based on the characteristics' variations or the characteristics' changes over time observed among the drive motors 5. This successfully prevents erroneous operations in which when a mode change is made from the securely-crimped position to the lightly-crimped position, the drive motor 5 receives a high drive voltage, and due to the inertial force of the drive motor 5, the mode is changed not to the lightly-crimped position but all the way to the off position. As such, the operations can be appropriately performed.

While the invention has been described in detail, the foregoing description about component shapes and configurations is in all aspects illustrative and not restrictive, and the scope of the invention should not be understood restrictively thereby.

What is claimed is:

1. A method of controlling a drive motor that is provided to a printer to apply a driving force to a predetermined operation section that prints an image on a printing sheet, comprising the steps of:

measuring, in an initialization operation in which no image is printed on the printing sheet, an initial operation time of the predetermined operation section by driving initially the drive motor to operate the operation section from a first predetermined position to a second predetermined position;

driving, in an image printing operation of forming an image on the printing sheet, the drive motor with a first non-zero output from an operation start time to a time calculated by multiplying the measured initial operation time by a coefficient that is larger than 0 but smaller than 1; and driving, until an operation end time after the drive motor is driven with the first output, the drive motor with a second non-zero output that is equal to or less than the first output and is determined as a function of the measured initial operation time.

2. The drive motor control method according to claim 1, wherein after the drive motor is driven with the first output, a time remaining until the operation end time is split into a plurality of segments, and the drive motor is driven with non-zero output levels varying among the plurality of segments.

3. The drive motor control method according to claim 1, wherein the second output is less than the first output.

4. The drive motor control method according to claim 1, wherein the drive motor is driven with decreasing non-zero output levels across the plurality of segments.

5. The drive motor control method according to claim 1, wherein the first predetermined position and the second predetermined position are on opposite sides of a slide rail.

6. The drive motor control method according to claim 1, wherein the first predetermined position and the second predetermined position are 360° apart on a rotationally driven drive element.

7. A printer, comprising:

a predetermined operation section that prints an image on a printing sheet;

a drive motor that applies a driving force to the predetermined operation section a control section that controls a drive state of the drive motor; and a timer that counts an initial operation time of the predetermined operation section from a first predetermined position to a second predetermined position during an initialization operation in which no image is printed, wherein in an image printing operation of forming an image on the printing sheet, the drive motor is driven with a first non-zero output from an operation start time to a time calculated by multiplying the counted initial operation time by a coefficient that is larger than 0 but smaller than 1, and until an operation end time after the drive motor is driven with the first output, the drive motor is driven with a second non-zero output that is equal to or less than the first output and is determined as a function of the counted initial operation time, wherein after the drive motor is driven with the first output, a time remaining until the operation end time is split into a plurality of segments and the drive motor is driven with non-zero output levels varying among the plurality of segments.

8. The printer according to claim 7, wherein the drive motor is driven with decreasing non-zero output levels across the plurality of segments.

* * * * *